US007093576B2

(12) United States Patent
DeRaad

(10) Patent No.: US 7,093,576 B2
(45) Date of Patent: Aug. 22, 2006

(54) SYSTEM AND METHOD TO PRIME AN ELECTRONIC RETURNLESS FUEL SYSTEM DURING AN ENGINE START

(75) Inventor: Scott DeRaad, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 234 days.

(21) Appl. No.: 10/869,198

(22) Filed: Jun. 15, 2004

(65) Prior Publication Data

US 2005/0274362 A1 Dec. 15, 2005

(51) Int. Cl.
*F02M 37/18* (2006.01)

(52) U.S. Cl. ..... 123/179.17; 123/497

(58) Field of Classification Search ..... 123/179.16, 123/179.17, 497, 457–458
See application file for complete search history.

(56) References Cited

U.S. PATENT DOCUMENTS 5,237,975 A 8/1993 Betki et al.
5,408,975 A 4/1995 Blakeslee et al.
5,425,342 A * 6/1995 Ariga et al. ..... 123/456
5,572,964 A * 11/1996 Cogneville et al. .... 123/179.17
5,651,347 A * 7/1997 Oi et al. ..... 123/487
5,711,275 A * 1/1998 Minagawa et al. ..... 123/458
5,749,344 A 5/1998 Yoshiume et al.
5,819,709 A 10/1998 Homes et al.
5,927,253 A 7/1999 Oyafuso et al.
6,269,801 B1 8/2001 Channing
6,276,532 B1 8/2001 Sperry et al.
6,279,532 B1 * 8/2001 Takano et al. ..... 123/357
6,408,822 B1 * 6/2002 Rembold et al. ..... 123/447
6,415,770 B1 * 7/2002 Kojima ..... 123/511
6,450,147 B1 * 9/2002 Demura et al. ..... 123/458
6,453,878 B1 9/2002 Mazet
6,761,151 B1 * 7/2004 Kojima ..... 123/458
6,918,367 B1 * 7/2005 Denz et al. ..... 123/179.17
6,923,159 B1 * 8/2005 Sakumoto et al. ..... 123/446
6,964,262 B1 * 11/2005 Hayakawa ..... 123/458

FOREIGN PATENT DOCUMENTS

GB 2293895 4/1996

* cited by examiner

*Primary Examiner*—Thomas Moulis
(74) *Attorney, Agent, or Firm*—Allan J. Lippa; Alleman Hall McCoy Russell & Tuttle LLP

(57) ABSTRACT

A method for priming a fuel injected internal combustion engine with a returnless fuel system having a check valve and initiating a fuel pump with a command signal. After said initiation, adjusting said command signal as a sensed fuel pressure varies to achieve a fuel pressure and holding said command signal for a hold period after achieving said fuel pressure.

25 Claims, 6 Drawing Sheets

SYSTEM AND METHOD TO PRIME AN ELECTRONIC RETURNLESS FUEL SYSTEM DURING AN ENGINE START

BACKGROUND AND SUMMARY

In vehicles having an internal combustion engine with an electronic returnless fuel system (ERFS), fuel priming methods may be used for fuel delivery during an engine start to achieve a desired air-fuel ratio (A/F ratio). Two such methods include: 1) open-loop fuel pump priming to a predetermined, fixed fuel pump input voltage in combination with a closed-loop fuel pump after priming/initialization, and 2) closed-loop fuel pump priming to a specified fuel pressure target value.

The priming method involving an open-loop fuel pump priming an engine to fixed fuel pump input voltage may be effective in achieving rapid fuel pressure rise times. In this method, the fixed fuel pump input voltage may be maximized during priming. Despite this maximization, the inventors herein have recognized a number of potential issues with such a control method.

One issue of this open-loop system priming to a fixed input voltage is that the resultant fuel pressure at the end of open-loop operation may be dependant on the available fuel pump electrical input power. Further, this end fuel pressure may be independent of a desired target fuel pressure. Thus, the fuel pressure may overshoot the target fuel pressure during priming. Additionally, this method may promote the closure of the check valve in the fuel delivery line. As a result, there may be disrupted feedback from the fuel pump to the injection pressure sensor. This may allow fuel pressure to build incrementally to the limit of the pressure relief valve under subsequent ignition key cycles during engine priming.

An alternative control method utilizing a closed-loop fuel pump controlled to a specified fuel pressure target value may overcome some of the disadvantages of the above-described open-loop system. The specific target pressure of a closed-loop may be a function of one or more input factors, including, but not limited to, engine temperature, fuel temperature, or barometric pressure. This method may be effective in enabling fuel pressure to be controlled to the target fuel pressure.

However, the inventors herein have recognized a number of potential issues with such a closed-loop fuel priming control method. For example, when using control gain values that give a desired fuel pressure control during running engine operation, these values may result in undesirable, slow fuel pressure rise times during priming. Likewise, the gain values that can provide fast pressure rise times during priming may result in fuel pressure variation during running engine operation.

At least some of the disadvantages of both of the above described fuel system priming methods may be overcome by a method for priming a fuel injected internal combustion engine with a returnless fuel system having a check valve. The method comprises initiating a fuel pump with a command signal; after said initiation, adjusting said command signal as a sensed fuel pressure varies to achieve a fuel pressure; and holding said command signal for a hold period after achieving said fuel pressure. In one example, the initiating command signal may be an open-loop signal held substantially constant for a first period.

Thus, in one example, an initial open-loop control can be used that is later modified by information for sensed pressure. In this way, advantages of both open and closed-loop control may be achieved, while reducing at least some of the above identified issues. For example, by using a holding period, it may be possible to maintain a substantially zero pressure differential across the check valve in the fuel system while the system is deadheaded, thereby reducing the potential for disrupting the ability for feedback. Further, such operation may provide for increased responsiveness once fuel injection begins. In this way, it may be possible to obtain accurate initial priming of the fuel system, while also compensating for various external effects.

In another embodiment, at least some of the disadvantages of both of the above described fuel system priming methods may be overcome by a method for priming a fuel injected internal combustion engine with a returnless fuel system, comprising: calculating a target fuel pressure based on operating conditions; initiating a fuel pump using an open-loop control; increasing fuel pressure to a target pressure using a closed-loop control; maintaining a command fuel pump output value at the targeted fuel pressure; anticipating a first fuel injection; and adjusting the command fuel pump output to a level necessary to satisfy flowing fuel injection requirements prior to fuel injection.

Thus, the inventors herein have recognized that a priming system utilizing both an open-loop control and a closed-loop control may enhance the robustness of initial fuel delivery during an engine start and limit fuel delivery variability by minimizing fuel pressure rise time to a targeted fuel pressure. Note that both the open-loop and closed-loop controls may include calculations based on engine operating conditions. In this method, the operating conditions upon which the target fuel pressure may be calculated may include fuel temperature, barometric pressure, and/or engine temperature but may be independent of the fuel pump electrical input power and the number of ignition key cycles.

Further, the method may use a delay mechanism in order to provide time for the fuel pressure to rise to the target pressure. The mechanism may be any mechanism capable of being activated during or after the open-loop control initiates the fuel pump. One such mechanism may be a passive anti-theft security system (PATS). PATS may be initiated immediately after the intelligent open-loop fuel pump command is directed to the fuel pump, or during the initial pressure rise of the open-loop fuel pump operation. Therefore, the fuel pump command signal may be sent to the fuel pump for an amount of time indirectly controlled by the duration of time required to complete the PATS subroutine. If PATS is not used, a timer could be substituted to act in a similar way as a delay mechanism to provide the time necessary for the fuel pressure to rise to the target pressure.

In still another example, a method for priming a fuel injected internal combustion engine with a returnless fuel system having a check valve, the method comprising: initiating a fuel pump with a command signal; after said initiation, achieving a fuel pressure with a command signal at a first level; and before a first fuel injection event, increasing said command signal to a second level higher than said first level to reduce a decreasing of fuel pressure caused by commencement of said first fuel injection event.

By increasing fuel pressure in anticipation of a first injection and reducing a drop in fuel pressure, it may be possible to obtain more consistent and accurate fuel control during starting, thereby reducing emissions.

Example advantages that may be achieved by various example embodiments disclosed herein may include the ability to control fuel delivery during an engine start, so as to limit fuel delivery variability as well as provide robust fuel delivery at an engine start.

DESCRIPTION OF EXAMPLE EMBODIMENT(S)

Figure 1:
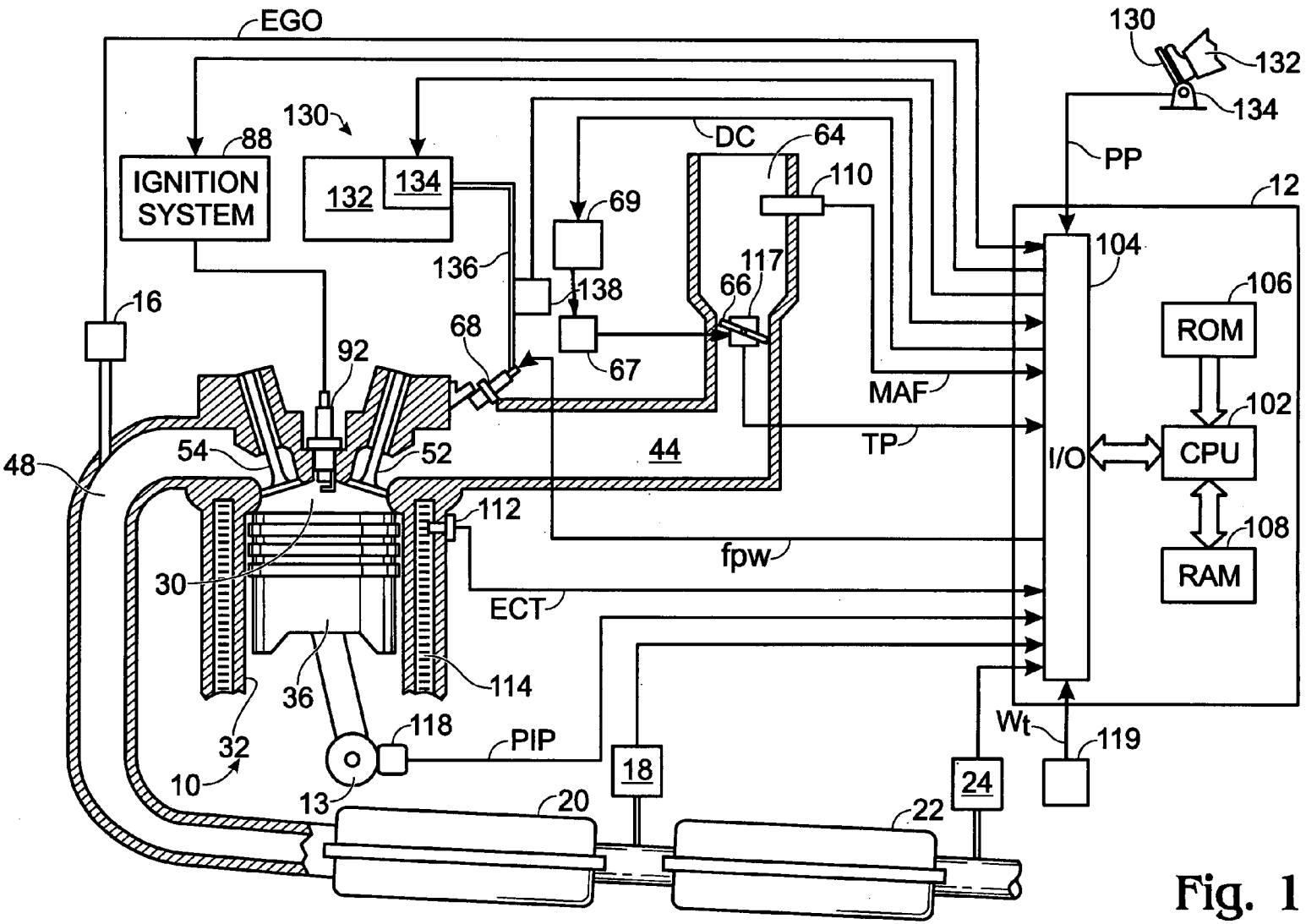
FIG. 1 is a block diagram of an engine.

Referring to FIG. 1, an internal combustion engine 10 may include a returnless fuel delivery system that may be utilized during an engine start. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12.

Fuel is delivered to fuel injector 68 by a fuel system 130 including a fuel tank 132, fuel pump module 134 having a fuel pump with a check valve and pressure relief valve, and fuel rail 136. Note that the check valve may be external to the fuel pump module in an alternative example. The fuel pump module may be within the fuel tank as shown, or remote from the tank in an alternative embodiment. The fuel system may utilize the fuel pump to supply fuel to a plurality of fuel injectors in proportion to a pulse width of signal (fpw) from a controller. The fuel pump output may be controlled by controller 12 that monitors the fuel pressure at the engine fuel charging assembly from sensor 138. Note that pressure sensor 138 can be located in a variety of other locations, for example.

In the returnless fuel system 130, achieving a desired air/fuel (A/F ratio) ratio during an engine start may be desired. A desired A/F ratio may be used to create a robust engine start and reduce emissions. To achieve a desired A/F ratio, an engine with an ERFS may be primed with fuel by an electronic control system prior to the engine starting, as described in more detail below.

Engine 10 further includes distributorless ignition system 88 to provide ignition spark to combustion chamber 30 via spark plug 92 in response to controller 12. In the embodiment described herein, controller 12 is a microcomputer including: microprocessor unit 102, input/output ports 104, electronic memory chip 106, which is an electronically programmable memory in this particular example, random access memory 108, and a data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of turbine speed (Wt) from turbine speed sensor 119, where turbine speed measures the speed of shaft (not shown), a profile ignition pickup signal (PIP) from Hall effect sensor 118 coupled to crankshaft 13 indicating an engine speed (N); and an optional sensor to detect feedgas $NO_x$ concentration (not shown).

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

As will be appreciated by one of ordinary skill in the art, the specific routines described below in the flowcharts may represent one or more of any number of processing strategies, such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the invention, but is provided for ease of illustration and description. Although not explicitly illustrated, one of ordinary skill in the art will recognize that one or more of the illustrated steps or functions may be repeatedly performed depending on the particular strategy being used. Further, these figures graphically represent code to be programmed into the computer readable storage medium in controller 12.

Figure 2:
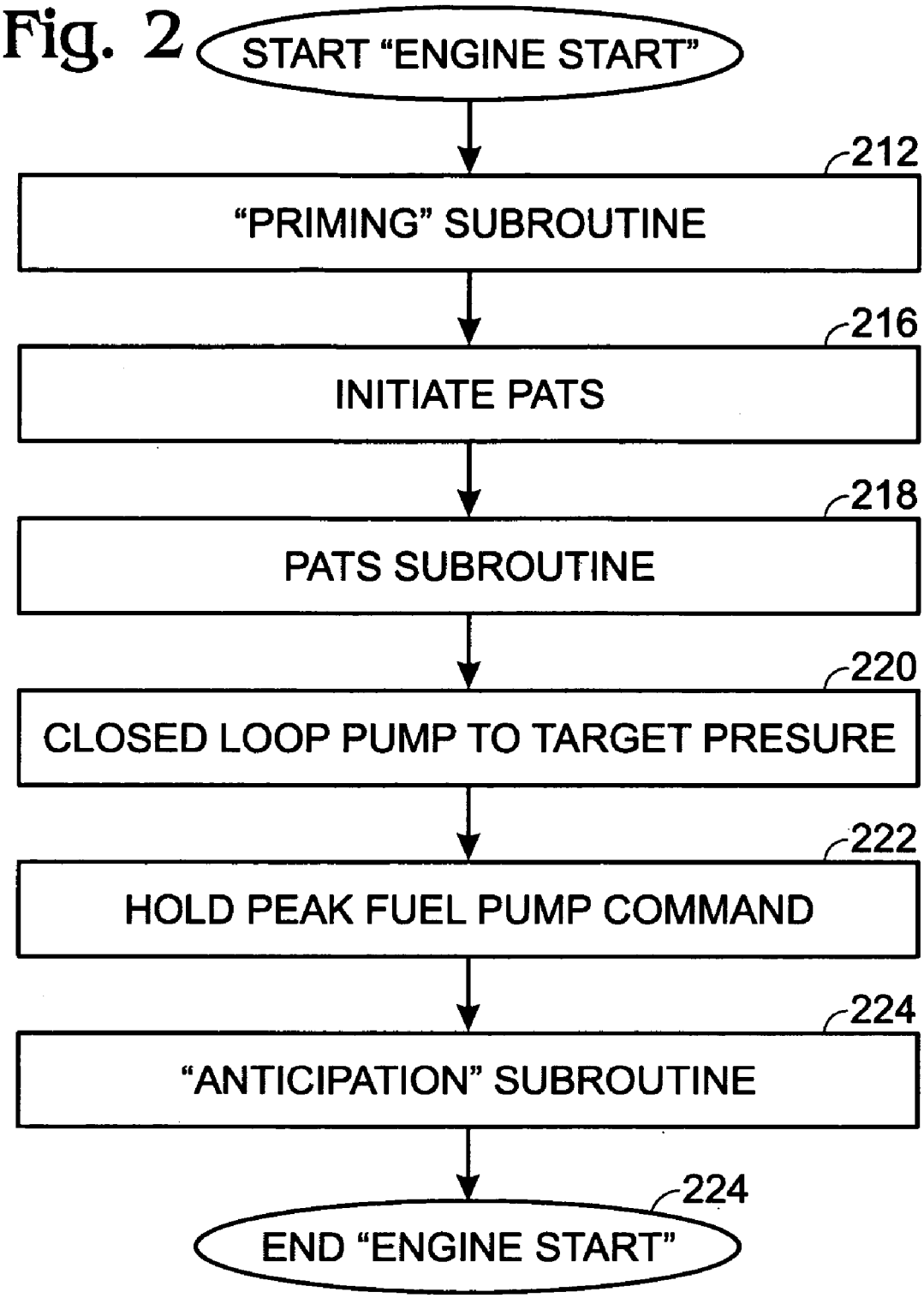
FIGS. 2–4 are exemplary routines for controlling fuel pump delivery during an engine start.

Referring now to FIG. 2, a routine is described for controlling a returnless fuel delivery system during an engine start. First, an engine start is initiated, such as by an operator turning an ignition key, for example. Upon this start, in step 212, a priming subroutine is called. As one example, a target fuel pressure is calculated based on one or more operating conditions. These operating conditions may include fuel temperature, barometric pressure, and/or engine temperature, and further may be independent of the fuel pump electrical input power, or the number of ignition key cycles. Further, the fuel pump is initiated using open-loop control with this target pressure. Note that in one example, the open-loop command directed to the fuel pump may be set at or below the target fuel pressure in order to prevent (or reduce) the fuel pressure from overshooting the target pressure. A more detailed example priming routine is described below with regard to FIG. 3.

Immediately upon completion of the priming, in step 216, a PATS system is initiated. In an alternative method, any suitable delay mechanism may be initiated in step 216, including a timer or any other mechanism suitable for controlling for a period of time to allow the fuel pressure to rise to the target pressure. If PATS is used as shown here, the fuel pump command signal is sent to the fuel pump for an amount of time indirectly controlled by the duration of time required to complete the PATS subroutine, in step 218.

Next, in step 220, closed-loop pump control increases the fuel pressure to the target pressure calculated in step 212. Closed-loop control may also prevent the fuel pressure from overshooting the target pressure. In one example closed-loop control may include calculating an error between a desired fuel pressure and a sensed fuel pressure, and then using this error with proportional, integral, and or derivative gains to generate an adjustment to the fuel pump command signal (e.g., duty cycle). It may be important that the fuel pressure overshoot relative to the target pressure be minimized or reduced because prior to the beginning of fuel injection, the fuel delivery system may be deadheaded, and due to the configuration of the check-valves in the fuel delivery lines, fuel system pressure that exceeds the target pressure may not be subsequently decreased until the fuel injectors begin operating. Note that this closed-loop fuel pump control to the target fuel pressure could be eliminated if the open-loop fuel pump initialization of step 214 was calibrated to provide the target fuel pressure with sufficient robustness.

Continuing onto step 222, after the desired target pressure has been achieved, the commanded fuel pump output value corresponding to the target pressure may be held constant. Holding the commanded fuel pump output value at the target pressure may maintain a substantially zero pressure differential across the check valve in the fuel delivery line while the system is deadheaded, and thus, reduce potential for breaking the closed-loop feedback from the fuel pump to the injection pressure sensor in the fuel rail. In other word, if pressure becomes too high, the check valve may close, and as a result may disrupt the feedback control as an unknown disturbance which may result in degraded performance.

An additional benefit of holding the commanded fuel pump output at the target fuel pressure is that the state of the fuel pump may be maintained at maximum readiness to respond to the first injection event where the pump/fuel system will be expected to react to increased output requirements.

Figure 4:
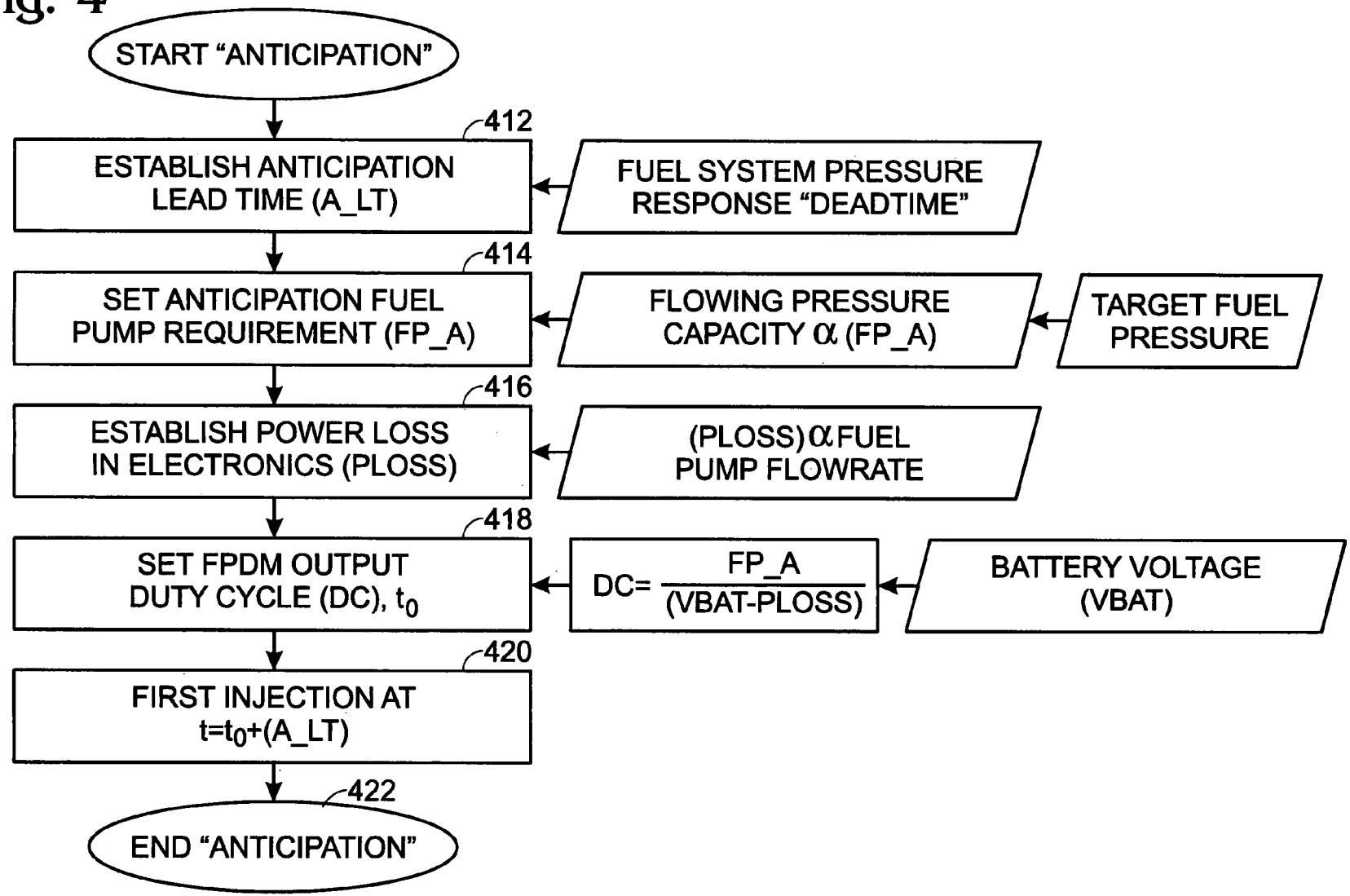

In step 224, the routine anticipates the first injection of an engine start by boosting fuel pump output. In one example, before the first injection is commenced, the routine increases the pump command signal. At the first injection, the fuel delivery system transitions from a deadheaded system to a flowing system and the fuel pressure abruptly drops. The routine of FIG. 4 is one example anticipation subroutine that may be used in step 224.

In one example of anticipating this pressure drop, the commanded fuel pump signal output is adjusted to the expected level necessary to satisfy the flowing fuel injection requirements prior to the start of fuel injection. One such method of adjusting the fuel pump output is to calculate the fuel system response time so as to remove the response deadtime. This could result in the fuel pump flow output at the fuel rail increasing at the same time as the first injection event. By doing so, the fuel pump may compensate for an anticipated fuel pressure drop without inaccurately biasing the pre-injection measurement of fuel pressure.

Step 226 is the end of the engine start routine. Most commonly, the end of the routine is the first injection of fuel into the combustion chamber, which transitions the fuel delivery system into a free flowing system. The first injection can be a simultaneous firing of all or a portion of all injectors, or sequential fuel injection.

Figure 3:
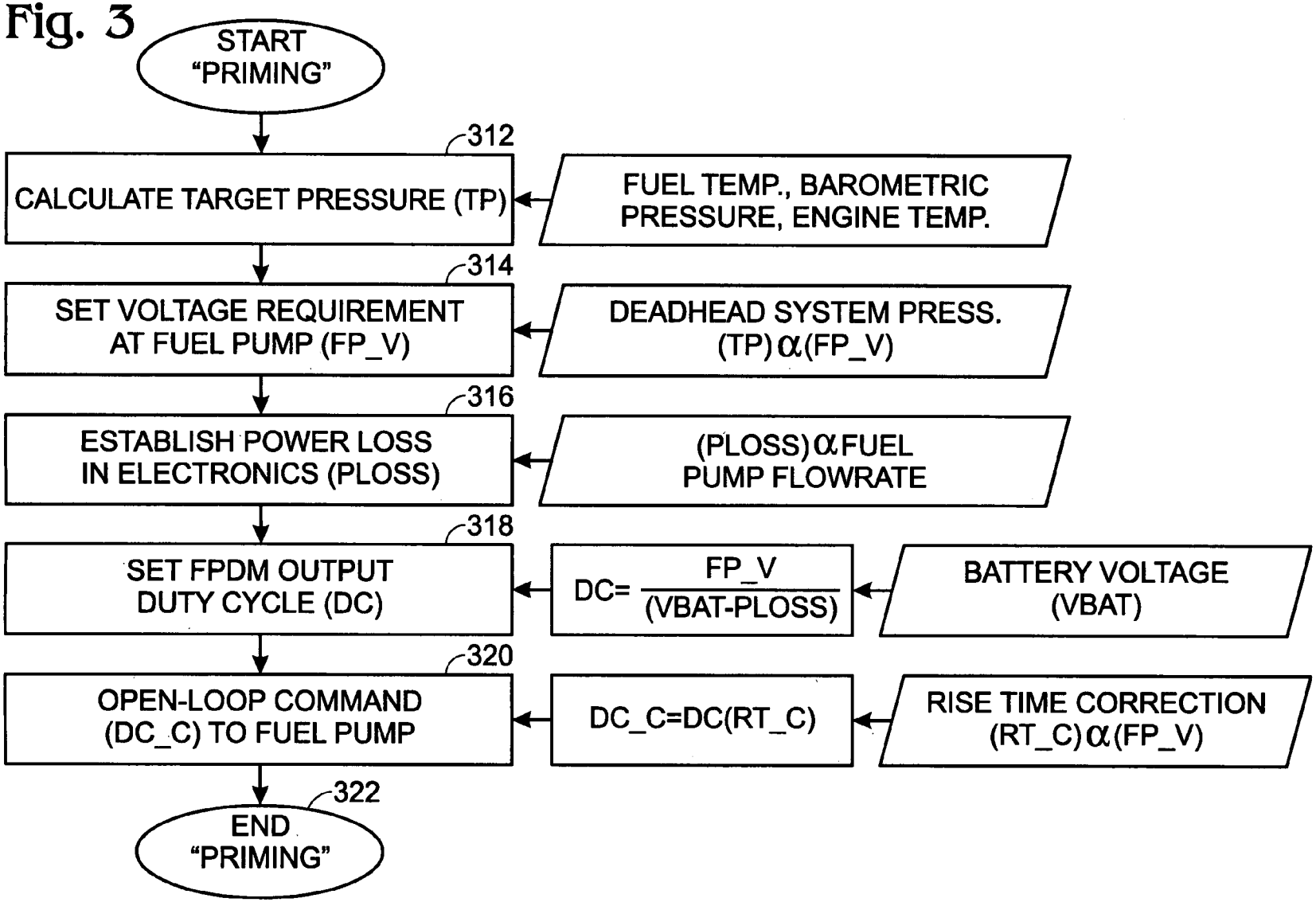

Referring now to FIG. 3, the open-loop method for priming a returnless fuel system of step 214 is described in further detail. In step 312, upon the initiation of an engine start, a target fuel pressure (TP) is calculated based on one or more operating conditions, including fuel temperature, barometric pressure, and/or engine temperature. In step 314 the fuel pump voltage (FP_V) required to achieve the target pressure is determined based on the target fuel pressure and the deadhead pressure capacity of the fuel pump. At step 316, power loss in the electronics (PLOSS) is estimated, based in part on the fuel pump flow rate. Based on the above calculations and the battery voltage (VBAT), in step 318 the routine sets the fuel pump driver module (DM) output duty cycle (DC). Note that the function of the driver module may be incorporated into controller 12, or provided via a separate electronic control unit.

Continuing onto step 320, an open-loop command (DC_C) is directed to the fuel pump. In step 320, DC can be further corrected to account for the response performance of a fuel pump as a function of FP_V. By adjusting DC to account for FP_V, fuel pressure rise times can be further optimized. The resulting open-loop command (DC_C) thus may be a function of a number of the above calculations and sensor readings, including DC, FP_V, PLOSS, and the battery voltage, VBAT. The open-loop command functions to direct the fuel pump to increase pressure to the target pressure under a routine similar to that described in FIG. 2. In step 322, the open-loop routine ends after the command is sent to the fuel pump.

FIG. 4 further describes in greater detail one example embodiment for the anticipation of the first injection of step 224 in FIG. 2. The first step of this example, step 412, is the establishment of the anticipation lead time (A_LT). The A_LT is based on factors including the fuel system pressure response deadtime. In the following step 414, the anticipated required fuel pump voltage (FP_A) is determined based on the target fuel pressure and the flowing pressure capacity. Step 416 estimates the power loss in the fuel system electronics, PLOSS, based on factors including the fuel pump flow rate.

Continuing onto step 418, the routines utilizes many of the factors calculated in prior steps 412–416, the VBAT in setting the initial fuel pump output duty cycle at time $t_0$. In step 429, the first injection occurs at a time equal to $t_0$ plus the anticipation lead time (A_LT) determined in step 412. Once the first injection occurs, anticipation of this injection ends.

Figure 5:
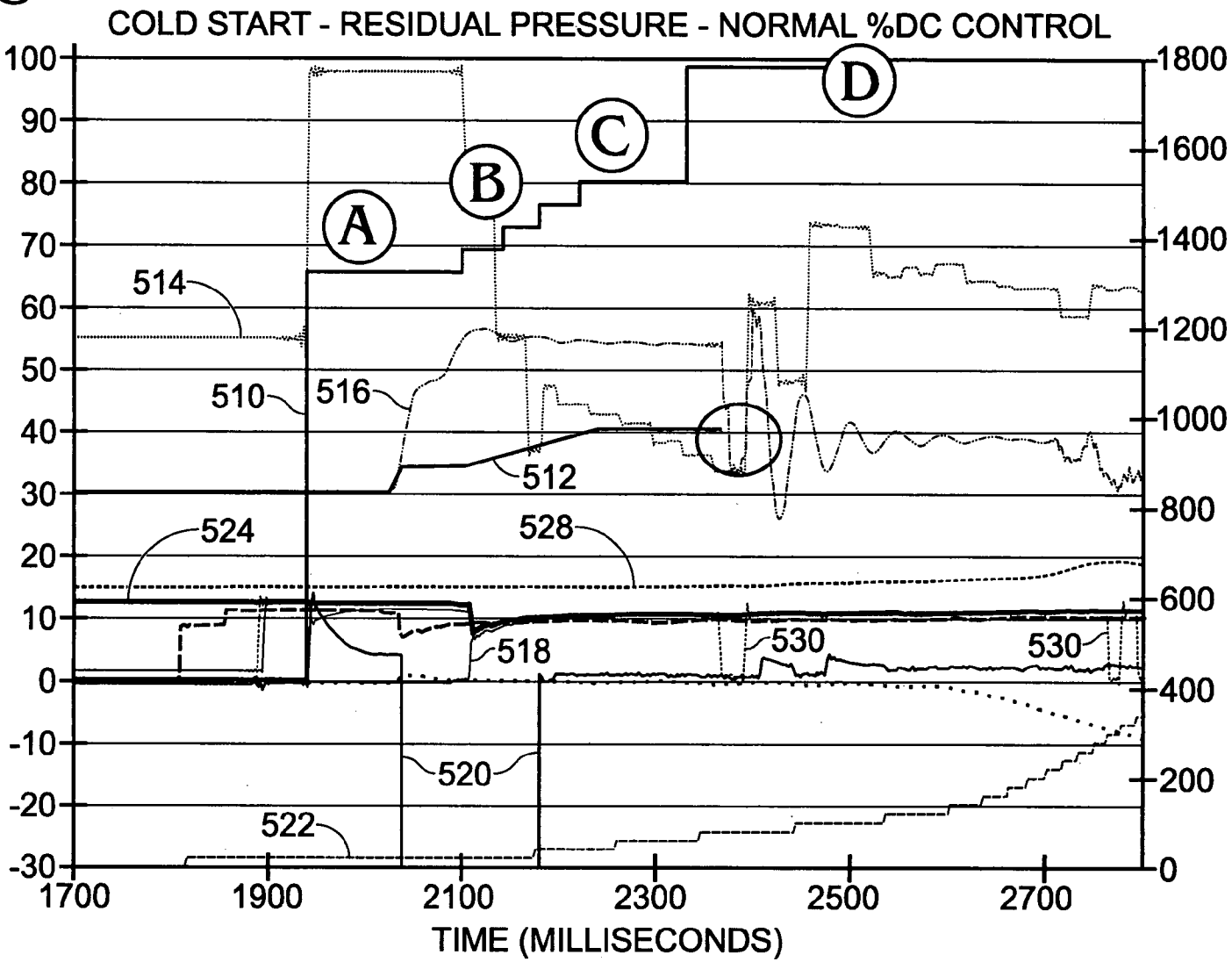
FIGS. 5–6 are graph of experimental and predicted results involving fuel pump delivery during an engine start.
Figure 6:
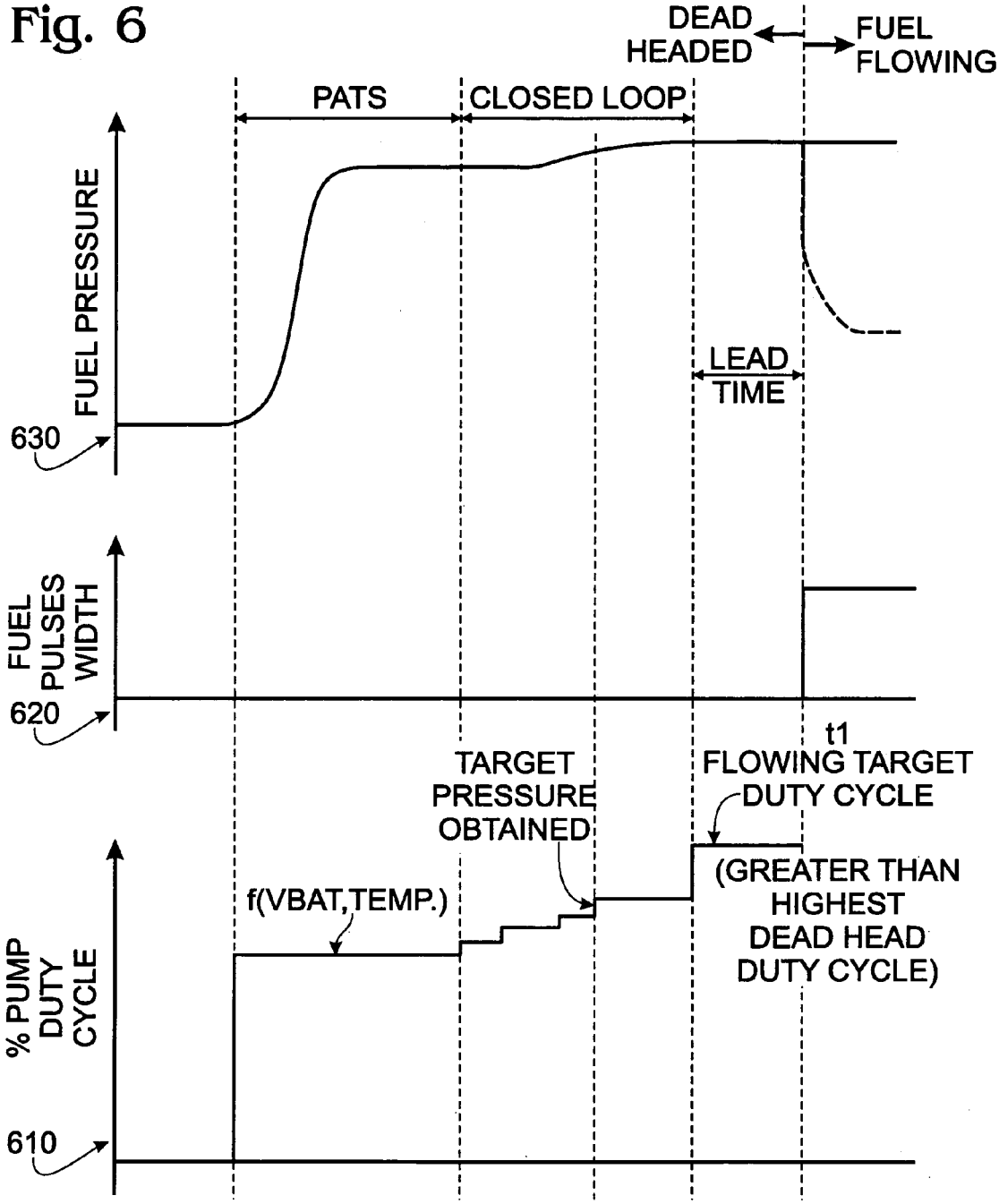

The inventors have performed a number of experiments on fuel delivery during an engine start. These experimental results revealed the relationships between fuel pump control commands and fuel pressure response during a cold engine start. FIGS. 5 and 6 demonstrate these experimental results and show data that can be advantageously used to achieve improved fuel delivery performance.

Referring to FIG. 5, this plot contains typical performance of the fuel pump control command, line 514, and fuel pressure response, line 516, during an engine cold start. The plot also contains the proposed fuel pump control command output, line 510, in which A represents a period of open-loop command to the fuel pump, B is a closed-loop control to the target pressure, C is fuel pump command hold at target pressure, D is a anticipation of the first injector. Line 512 represents the expected fuel pressure response to the proposed fuel pump control 512.

FIG. 5 further demonstrates how various components of the engine may function during an engine start using the proposed methodology for fuel pump control of line 510. The lines toward the bottom of the plot depict these various engine components during the proposed fuel pump command: line 518 plots the starter (Volt_STARTER), line 520 plots the pump current, line 522 plots the engine RPM, line 524 plots the battery (VBAT), line 514 plots the fuel pump pulse width modulated duty cycle (PumpPWM_DC), line 528 plots the air to fuel ratio (AF_Ratio), and line 530 plots one of the fuel injectors.

FIG. 6 contains alternative example plots of the disclosed methodology for fuel pump control during an engine start. Plot 610 of FIG. 6 plots the % pump duty cycle during the open-loop fuel pump initiation command, the initiation of the PATS, including the PATS subroutine, the closed-loop fuel pump command to the target pressure, and the increased flowing target duty cycle in anticipation of the first injector which is greater than the highest dead head duty cycle and after the first fuel injection. Line 620 plots the fuel pulses width (fpw) of the fuel during these same phases of the engine start methodology, and line 630 plots the fuel pressure during these phases. Taken together the plots of FIG. 6 demonstrate that the disclosed methodology of fuel pump control during an engine start may provide robust fuel delivery during an engine start without overshooting a functional fuel pressure limit, and reduce or eliminate the fuel pressure drop at the first injection. Specifically, in the top plot, the solid lines shows example operation in which the pressure drop that normally corresponds with the rise in the fuel pulse width at t1 (shown by the dashed line) may be reduced.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for priming a fuel injected internal combustion engine with a returnless fuel system having a check valve, the method comprising:

initiating a fuel pump with a command signal;

after said initiation, achieving a fuel pressure with a command signal at a first level; and before a first fuel injection event, increasing said command signal to a second level higher than said first level to reduce a decreasing of fuel pressure caused by commencement of said first fuel injection event.

2. The method of claim 1 wherein during at least a portion of said achieving said fuel pressure, said command signal is adjusted based on a target fuel pressure and then held substantially constant.

3. A method for priming a fuel injected internal combustion engine with a returnless fuel system having a check valve, the method comprising:

initiating a fuel pump with a command signal;

after said initiation, adjusting said command signal as a sensed fuel pressure varies to achieve a fuel pressure; and holding said command signal for a hold period after achieving said fuel pressure.

4. The method of claim 3 further comprising increasing said command signal after said holding but before a first injection begins.

5. The method of claim 3 wherein said initiating command signal is held substantially constant for a first period.

6. The method of claim 5 wherein said first period is correlated with a timer.

7. The method of claim 5 wherein said first period is correlated with a passive anti-theft system.

8. The method of claim 4 wherein said hold period is one of a fixed and variable period.

9. The method of claim 8 wherein different substantially constant command signals are used in different engine starts.

10. The method of claim 8 wherein said substantially constant command signal value during a first start at a first condition is higher than a second start at a second condition.

11. The method of claim 9 wherein said first condition is a first temperature, and said second condition is a second temperature different from said first temperature.

12. The method of claim 9 wherein said first condition is a first pressure, and said second condition is a second pressure different from said first pressure.

13. A Method for priming a fuel injected internal combustion engine with a returnless fuel system, the method comprising:

calculating a target fuel pressure based on operating conditions;

initiating a fuel pump using an open-loop control;

increasing fuel pressure to a target pressure using a closed-loop control;

maintaining a command fuel pump output value at the targeted fuel pressure;

anticipating a first fuel injection; and adjusting the command fuel pump output to a level necessary to satisfy flowing fuel injection requirements prior to fuel injection.

14. The method of claim 13 wherein said operating conditions include one or more of fuel temperature, barometric pressure, and engine temperature.

15. The method of claim 13 wherein said open-loop control consists of:

calculating a fuel pump voltage required to achieve the target fuel pressure;

calculating a power loss in the electronics;

establishing a fuel pump driver module output duty cycle; and sending an open-loop command to the fuel pump.

16. The method of claim 13 wherein said anticipation of the first fuel injection further comprises:

establishing an anticipated lead time;

calculating an anticipated fuel pump requirement;

estimating a power loss in the electronics;

establishing a set fuel pump output duty cycle; and calculating the time of the first injection.

17. The method of claim 13 which further comprises a delay mechanism.

18. The method of claim 17 wherein the delay mechanism is initiated after the open-loop control initiates the fuel pump and configured to provide the time necessary for fuel pressure to rise to the target pressure.

19. The method of claim 17 wherein the delay mechanism further is a passive anti-theft security system.

20. The method of claim 17 wherein the delay mechanism further is a timer.

21. A method for priming a fuel injected internal combustion engine with a returnless fuel system, the method comprising:

calculating a target fuel pressure based on operating conditions;

initiating a fuel pump using an open-loop control;

initiating a delay mechanism to provide a duration of time for fuel pressure to increase;

increasing fuel pressure to a target pressure using a closed-loop control;

maintaining a command fuel pump output value at the targeted fuel pressure;

anticipating a first fuel injection; and adjusting the command fuel pump output to a level necessary to satisfy flowing fuel injection requirements prior to fuel injection.

22. The method of claim 21 wherein the delay mechanism includes a timer.

23. The method of claim 21 wherein the delay mechanism includes a passive anti-theft security system.

24. The method of claim 23 wherein said anticipation of the first fuel injection further comprises:

establishing an anticipated lead time;

calculating an anticipated fuel pump requirement;

estimating a power loss in the electronic;

establishing a set fuel pump driver module output duty cycle; and calculating the time of the first injection.

25. A computer storage medium having instructions encoded therein for controlling a fueling system of a fuel injected internal combustion engine, the medium comprising:

instructions for priming a returnless fuel system, comprising:

instructions for initiating a fuel pump with a command signal;

instructions for holding said command signal for a period; and instructions for adjusting said command signal as a sensed fuel pressure varies, after said period.

* * * * *